US010100601B2

(12) United States Patent
King et al.

(10) Patent No.: US 10,100,601 B2
(45) Date of Patent: Oct. 16, 2018

(54) DOWNHOLE ASSEMBLY HAVING ISOLATION TOOL AND METHOD

(71) Applicants: James G. King, Kingwood, TX (US); William Aaron Burton, Houston, TX (US)

(72) Inventors: James G. King, Kingwood, TX (US); William Aaron Burton, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 438 days.

(21) Appl. No.: 14/947,602

(22) Filed: Nov. 20, 2015

(65) Prior Publication Data

US 2016/0186514 A1 Jun. 30, 2016

Related U.S. Application Data

(60) Provisional application No. 62/092,421, filed on Dec. 16, 2014.

(51) Int. Cl.
*E21B 29/02* (2006.01)
*E21B 33/134* (2006.01)
(Continued)

(52) U.S. Cl.
CPC ..... *E21B 33/134* (2013.01); *E21B 34/102* (2013.01); *E21B 43/116* (2013.01); *E21B 43/26* (2013.01); *E21B 2034/005* (2013.01)

(58) Field of Classification Search
CPC ..... E21B 43/116; E21B 43/119; E21B 23/00; E21B 33/134; E21B 2034/005; E21B 2034/007; E21B 33/124
See application file for complete search history.

(56) References Cited

U.S. PATENT DOCUMENTS 4,637,468 A 1/1987 Derrick
5,180,009 A 1/1993 Sneed
(Continued)

FOREIGN PATENT DOCUMENTS

WO 2014099206 A1 6/2014
WO 2015038095 A1 3/2015
(Continued)

OTHER PUBLICATIONS

International Search Report and Written Opinion; International Application No. PCT/US2015/062409; International Filing Date: Nov. 24, 2015; dated Mar. 9, 2016; 10 pages.
(Continued)

*Primary Examiner* — Daniel P Stephenson
(74) *Attorney, Agent, or Firm* — Cantor Colburn LLP

(57) ABSTRACT

A downhole assembly includes an isolation tool disposable downhole of a perforation gun. The isolation tool includes a tubular body having a seat, and an occluding device supported on the tubular body in an unseated position, and movable to a seated position on the seat in response to at least one of a firing operation of the perforation gun and a selected fluid velocity through the isolation tool. Fluid communication through the isolation tool is allowed in uphole and downhole directions in the unseated position of the occluding device, and blocked in the downhole direction in the seated position of the occluding device.

21 Claims, 11 Drawing Sheets

(51) Int. Cl.

| | |
|---|---|
| ***E21B 34/10*** | (2006.01) |
| ***E21B 43/116*** | (2006.01) |
| ***E21B 43/26*** | (2006.01) |
| *E21B 34/00* | (2006.01) |

(56) References Cited

U.S. PATENT DOCUMENTS

| | | | | |
|---|---|---|---|---|
| 5,335,727 | A | 9/1994 | Cornette et al. | |
| 6,012,525 | A | 1/2000 | Burleson et al. | |
| 6,155,350 | A | 12/2000 | Melenyzer | |
| 6,220,360 | B1 | 4/2001 | Connell et al. | |
| 6,390,200 | B1 | 5/2002 | Allamon et al. | |
| 6,776,228 | B2 | 8/2004 | Pedersen et al. | |
| 6,802,372 | B2 | 10/2004 | Budde | |
| 6,959,766 | B2 | 11/2005 | Connell | |
| 7,100,700 | B2 | 9/2006 | Davis et al. | |
| 7,273,096 | B2 | 9/2007 | Den Boer et al. | |
| 7,624,810 | B2 | 12/2009 | Fould et al. | |
| 7,703,523 | B2 | 4/2010 | Wardley | |
| 7,770,652 | B2 | 8/2010 | Barnett | |
| 7,779,926 | B2 | 8/2010 | Turley et al. | |
| 8,091,628 | B2 | 1/2012 | Peer et al. | |
| 8,950,480 | B1 * | 2/2015 | Strickland | E21B 33/12 166/250.01 |
| 2004/0055753 | A1 | 3/2004 | Davis et al. | |
| 2005/0072577 | A1 * | 4/2005 | Freeman | E21B 34/14 166/386 |
| 2005/0241834 | A1 | 11/2005 | McGlothen et al. | |
| 2005/0241835 | A1 | 11/2005 | Burris, II et al. | |
| 2009/0159297 | A1 | 6/2009 | Fould | |
| 2011/0135953 | A1 | 6/2011 | Xu et al. | |
| 2011/0278017 | A1 | 11/2011 | Themig et al. | |
| 2012/0048562 | A1 | 3/2012 | Zimmerman et al. | |
| 2013/0020089 | A1 * | 1/2013 | Xu | E21B 34/102 166/373 |
| 2013/0062055 | A1 | 3/2013 | Tolman et al. | |
| 2013/0175053 | A1 | 7/2013 | Madero et al. | |
| 2013/0192846 | A1 | 8/2013 | Garcia et al. | |
| 2013/0248174 | A1 | 9/2013 | Dale et al. | |
| 2014/0116731 | A1 | 5/2014 | Themig et al. | |
| 2014/0262312 | A1 | 9/2014 | Tilley | |
| 2015/0068771 | A1 | 3/2015 | Richards et al. | |
| 2015/0068772 | A1 | 3/2015 | Richards et al. | |
| 2015/0136425 | A1 | 5/2015 | Burgos et al. | |
| 2015/0252640 | A1 | 9/2015 | Mailand et al. | |
| 2015/0252642 | A1 | 9/2015 | Mailand et al. | |
| 2015/0252643 | A1 | 9/2015 | Mailand et al. | |
| 2016/0061018 | A1 | 3/2016 | Ditzler | |
| 2016/0123129 | A1 | 5/2016 | Sanchez et al. | |
| 2016/0186514 | A1 * | 6/2016 | King | E21B 33/134 166/250.01 |
| 2016/0222764 | A1 | 8/2016 | Rorvik | |
| 2016/0312556 | A1 | 10/2016 | Silva et al. | |
| 2017/0145781 | A1 | 5/2017 | Silva | |
| 2017/0342806 | A1 * | 11/2017 | Themig | E21B 33/12 |
| 2018/0030807 | A1 * | 2/2018 | Martin | E21B 33/1277 |
| 2018/0119521 | A1 | 5/2018 | Silva | |

FOREIGN PATENT DOCUMENTS

| | | | |
|---|---|---|---|
| WO | 2015038096 | A1 | 3/2015 |
| WO | 2015084342 | A1 | 6/2015 |
| WO | 2015138254 | A1 | 9/2015 |

OTHER PUBLICATIONS

Bake Hughes, [online]; [retrieved Mar. 8, 2012]; retrieved from the Internet http://blogs.bakerhughes.com/reservoir/2010/09/18/completion-techniques-in-shale-reservoirs/, "Completion techniques in shale reservoirs" Baker Hughes Reservoir Blog, Sep. 18, 2010.

International Search Report and Written Opinion; International Application No. PCT/US2012/067732; International Filing Date: Nov. 24, 2015; dated Mar. 19, 2013; 13 pages.

International Search Report for International Application No. PCT/US2017/053992; dated Dec. 15, 2017; 4 pages.

Written Opinion of the International Search Report for International Application No. PCT/US2017/053992; dated Dec. 15, 2017; 7 pages.

* cited by examiner

DOWNHOLE ASSEMBLY HAVING ISOLATION TOOL AND METHOD

CROSS REFERENCE TO RELATED APPLICATIONS

This application claims the benefit of an earlier filing date from U.S. Provisional Application Ser. No. 62/092,421 filed Dec. 16, 2014, the entire disclosure of which is incorporated herein by reference.

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

Composite frac plugs generally have an open inner diameter that is occluded by a ball dropped from the surface. The reason for this arrangement is that if the guns don't fire after the plug is set, then the open inner diameter will permit pumping another set of guns downhole without mobilizing coiled tubing to open a flow path. In a "plug and perf" operation, a bottom hole assembly ("BHA") is run on wircline into a borchole that is typically cased and cemented and could include both horizontal and vertical sections. The BHA includes an isolation tool (the frac plug), a setting tool, and one or more perforation guns. The setting tool is actuated for packing off a production zone with the isolation tool. The one or more perforation guns are then positioned in the borehole and triggered by a signal sent down the wireline. Typically, balls are used for the isolation tools as such ball-accepting isolation tools provide fluid communication with lower zones, which enables sufficient fluid flow for redeploying the perforation guns in the event that they do not fire properly. After perforation, the BHA (excluding the isolation tool) is pulled out and a ball is dropped from surface for engaging a seat of the isolation tool for impeding fluid flow therethrough. While the process works adequately, it requires a significant amount of time and fluid to pump a ball downhole. Bridge plugs are occasionally used instead of ball type frac plugs, but these bridge plugs do not enable the aforementioned redeployment of failed perforation guns.

The art would be receptive to improved devices and methods for occluding a frac plug after firing of perforating guns.

BRIEF DESCRIPTION

A downhole assembly includes an isolation tool disposable downhole of a perforation gun. The isolation tool includes a tubular body having a seat, and an occluding device supported on the tubular body in an unseated position, and movable to a seated position on the seat in response to at least one of a firing operation of the perforation gun and a selected fluid velocity through the isolation tool. Fluid communication through the isolation tool is allowed in uphole and downhole directions in the unseated position of the occluding device, and blocked in the downhole direction in the seated position of the occluding device.

A method of completing a borehole includes running a downhole assembly having an isolation tool into the borehole, the isolation tool including a tubular body having a seat, and an occluding device supported on the tubular body in an unseated position, firing a perforation gun, and moving the occluding device from the unseated position to a seated position upon the seat only if the perforation gun is fired.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
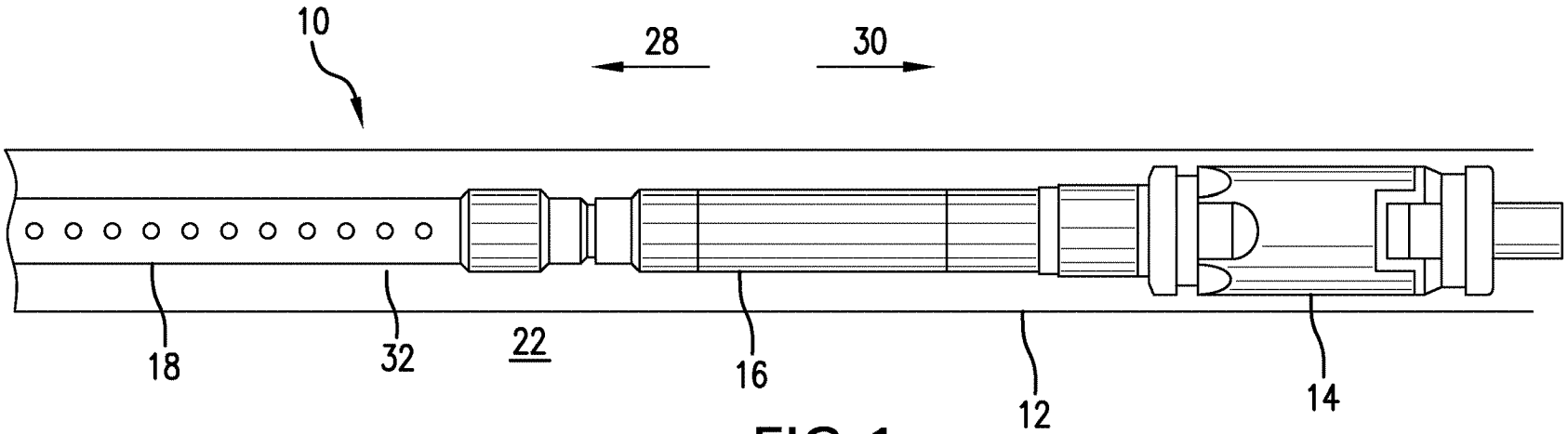
FIG. 1 depicts a schematic illustration of an embodiment of a downhole assembly.

Referring now to FIG. 1, an embodiment of a downhole assembly 10 is depicted within a downhole structure 12, such as a borehole that is lined, cased, cemented, etc. The assembly 10 may be run downhole by use of a wireline system. In the illustrated embodiment, the assembly 10 includes an isolation tool 14 (alternatively referred to as a "frac plug"), a setting tool 16, and a perforation gun 18.

In one embodiment, the assembly 10 is a bottom hole assembly ("BHA") for a "plug and perf" operation. The assembly 10 is positioned downhole and the isolation tool 14 is set in the structure 12 by the setting tool 16 for packing off a production zone 22. The isolation tool 14 could be retrievable, drillable, etc., and may be formed from composites, metals, polymers, etc. After a setting operation, the setting tool 16 may then be uncoupled from the isolation tool 14 and the perforation gun 18 positioned within the structure 12 for perforating the zone 22. Multiple perforation guns 18 could be included in the assembly 10 for forming multiple perforated sections in the zone 22 and other production zones.

With additional reference to FIGS. 2-11, after perforation, the uncoupled tools of the assembly 10 are removed (the isolation tool 14 remaining downhole) and an occluding device 24, corresponding to a complementarily formed seat 26 in the isolation tool 14, is seated within the isolation tool 14 for isolating opposite (downhole and uphole) sides of the isolation tool 14, thereby enabling a pressure up event to fracture the production zone 22 through the perforations in the structure 12 formed by the gun(s) 18. The occluding device 24 could be a ball, poppet, flapper member or take any other suitable form or shape receivable by the isolation tool 14. Also, the occluding device 24 may be seated within the isolation tool 14 as a direct result of the gun shock from the perforation gun 18 or from subsequent fluid velocity from a pressure event.

The assembly 10 includes the occluding device 24 during run-in and disposed in a pre-seated or unseated position within the isolation tool 14 so that the isolation tool 14 does not require an occluding device, such as a ball, to be subsequently dropped hundreds or thousands of feet from surface, thereby saving substantial time. In the unseated position of the occluding device 24, the isolation tool 14 still allows fluid communication therethrough in both uphole and downhole directions 28, 30. However, in the seated condition, the occluding device 24 seated within the isolation tool 14 will stop fluid communication from further flow in the downhole direction 30 through the isolation tool 14. The isolation tool 14 may serve as a one-way check valve that seals pressure, or at least substantially prevents fluid flow, from above the tool 14 in the downhole direction 30, but allows flow through the tool 14 from a downhole location in the uphole direction 28. In accordance with the above, the isolation tool 14 is shown in FIGS. 3-4, 6, 8, and 10 during set and open conditions, and transitions to the closed condition shown in FIGS. 5, 7, 9, and 11 for seating of the occluding device 24 after perforation.

Figure 2:
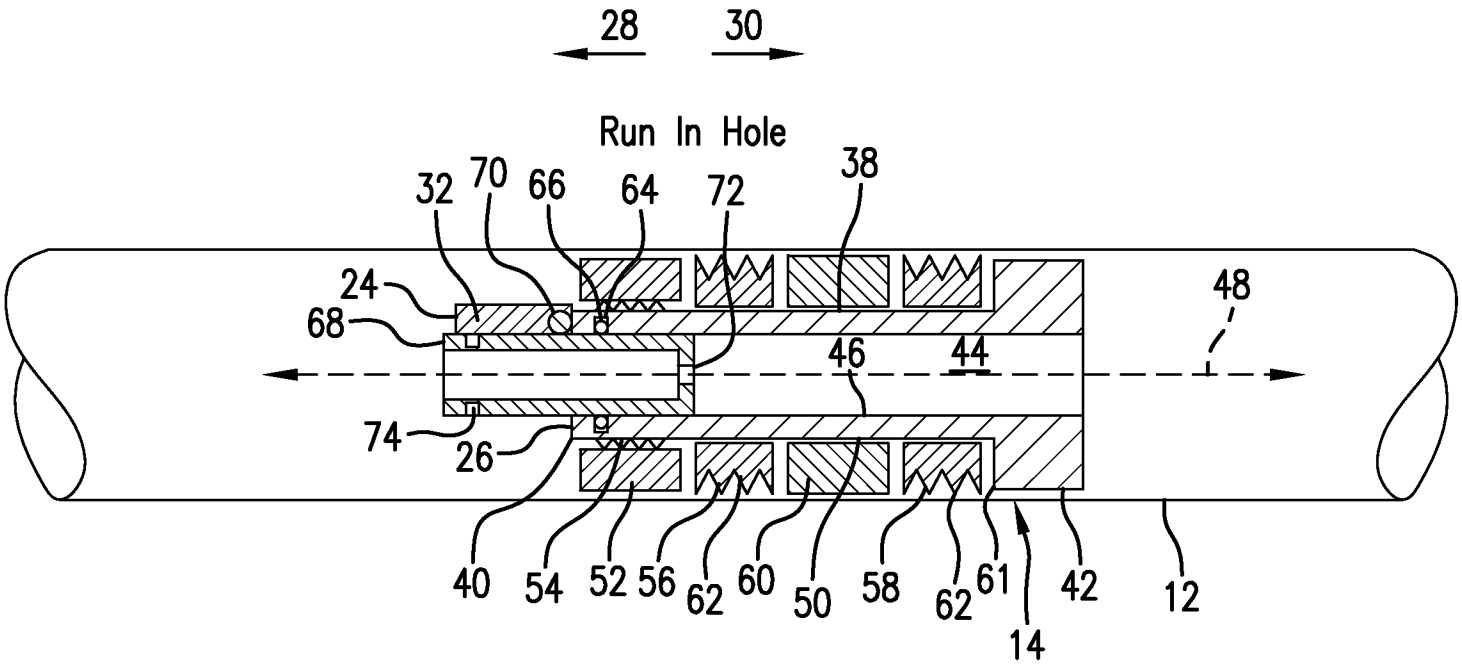
FIG. 2 depicts a sectional and schematic view of an embodiment of an isolation tool for the downhole assembly of FIG. 1 in a run-in configuration and having a flapper member.
Figure 3:
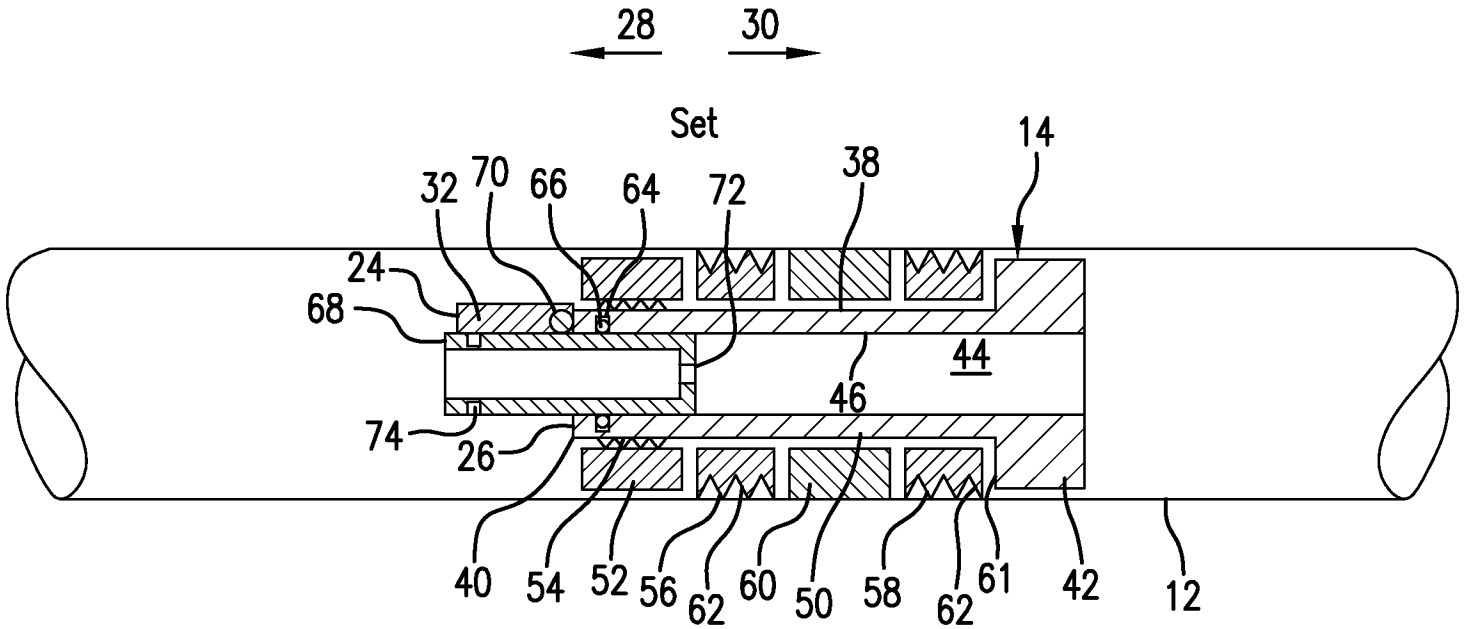
FIG. 3 depicts a sectional and schematic view of the isolation tool of FIG. 2 in a set condition.

As will be shown in FIGS. 2-11, the occluding device 24 may take various forms including, but not limited to, a flapper member 32 (FIGS. 2-5), a ball 34 (FIGS. 6-7), and a poppet 36 (FIGS. 8-11). In each embodiment, the occluding device 24 is incorporated into the isolation tool 14 such that only one tool 14 is needed, as opposed to an isolation tool 14 and a separate ball drop device, or as opposed to having to drop a ball from surface. The isolation tool 14 includes at least a tubular body 38 having an uphole portion 40 and a downhole portion 42. The tubular body 38 includes a flow channel 44 within an interior 46 of the tubular body 38 along a longitudinal axis 48 thereof allowing for fluid flow therethrough when the tubular body 38 is not blocked. Surrounding an exterior 50 of the tubular body 38 is a gauge ring 52, and a body lock ring 54 trapped or otherwise operatively disposed radially between the tubular body 38 and gauge ring 52. Also disposed on the exterior 50 of the tubular body 38 is at least one settable member, such as first and second (upper and lower) slips 56, 58 and a packing element 60 operatively disposed longitudinally between the first and second slips 56, 58. FIG. 2 shows the first and second slips 56, 58 and packing element 60 in a run-in condition where there is ample space between the slips 56, 58 and packing element 60 and the structure 12 to enable movement of the isolation tool 14 through the structure 12. FIGS. 3-11 show the first and second slips 56, 58 and packing element 60 in a set condition. The first and second slips 56, 58 and packing element 60 are movable from the run-in condition to the set condition using the setting tool 16 (FIG. 1). One embodiment of setting the isolation tool 14 is by moving the gauge ring 52 and body lock ring 54, using the setting tool 16, in the downhole direction 30 with respect to the tubular body 38, thus compressing the slips 56, 58 and packing element 60 axially between the gauge ring 52 and body lock ring 54 and a relatively stationary downhole portion of the tubular body 38, such as stop shoulder 61. Axial compression of slips 56, 58 and packing element 60 may also enable radial expansion or movement of the slips 56, 58 and packing element 60. The slips 56, 58 may be provided with gripping teeth 62 such that once dug into the structure 12, the isolation tool 14 will be set and the tubular body 38 will be relatively stationary with respect to the structure 12. The packing element 60 may include an elastomeric material to provide a seal between the tubular body 38 and an inner surface of the structure 12.

Figure 4:
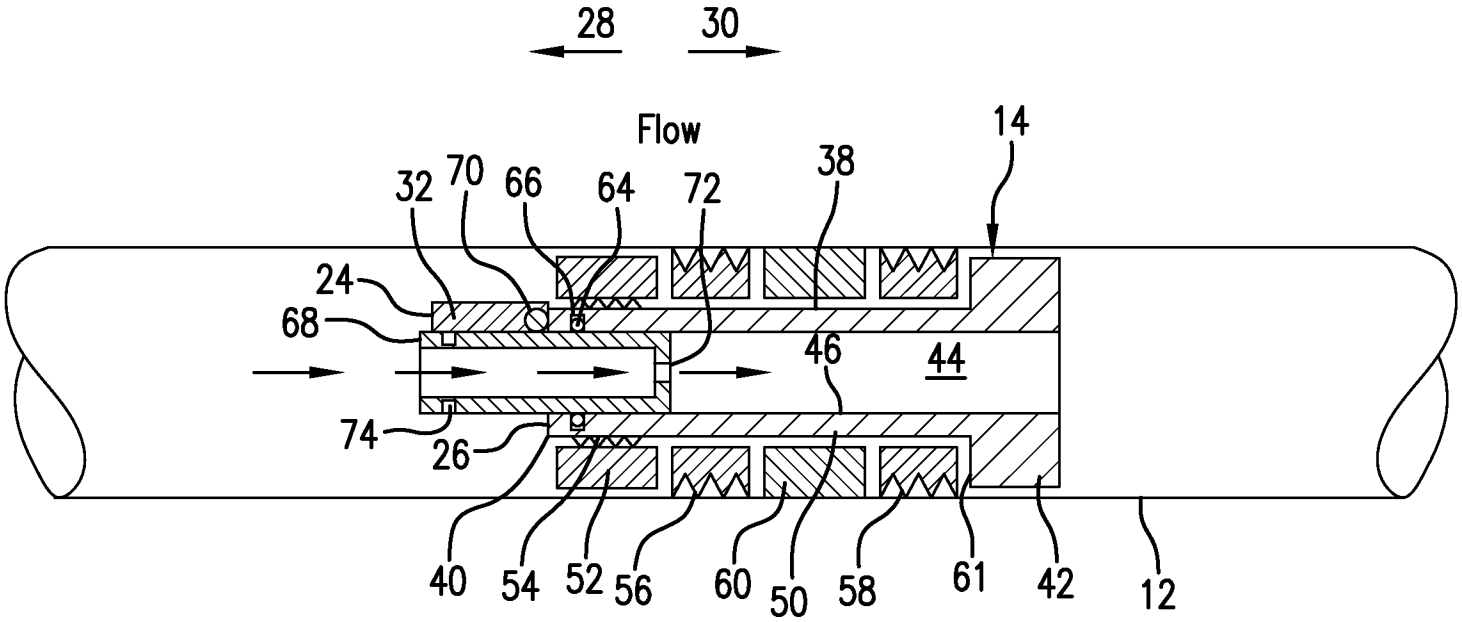
FIG. 4 depicts a sectional and schematic view of the isolation tool of FIG. 2 in the set condition and an open condition, allowing fluid communication in a downhole direction.
Figure 5:
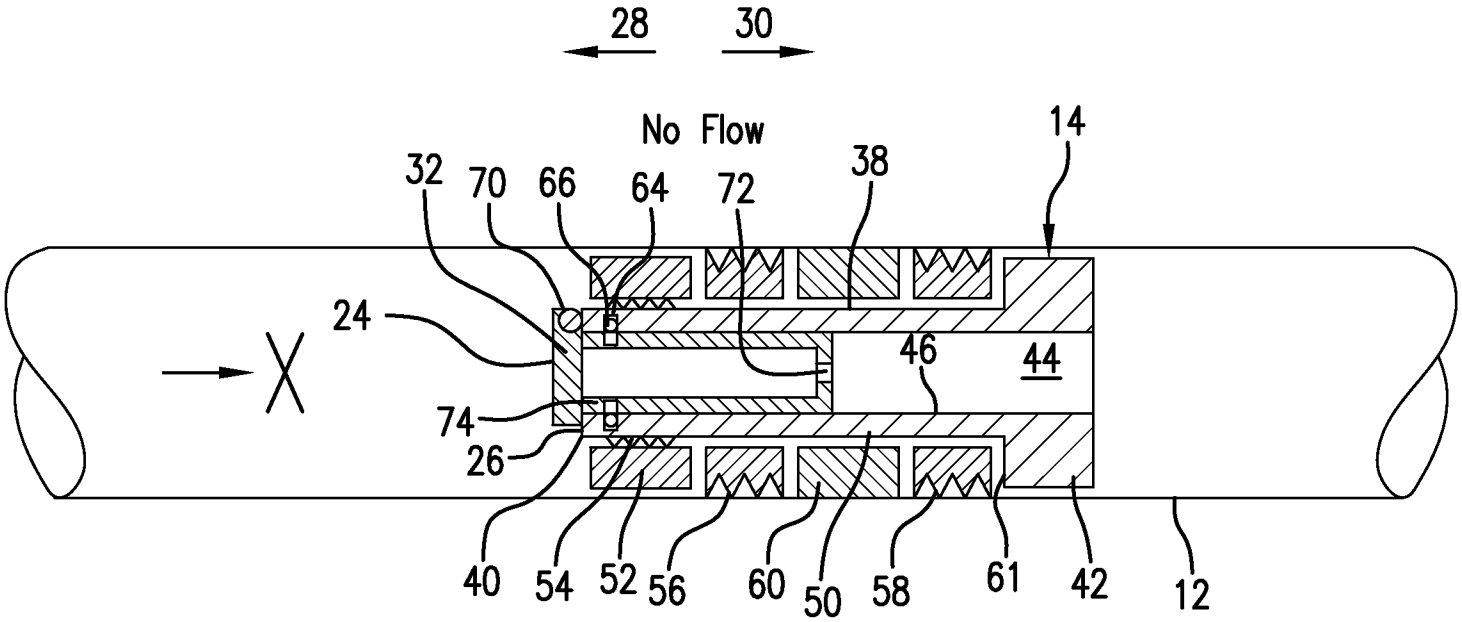
FIG. 5 depicts a sectional and schematic view of the isolation tool of FIG. 2 in a closed condition.

As further shown in FIGS. 2-5, the tubular body 38 may include an interior groove 64 on the interior 46 to receive a snap ring 66 therein. The snap ring 66 is radially expanded beyond its biased condition, and trapped within the interior groove 64 by a longitudinally movable sleeve 68. Pivotally attached to the uphole portion 40 of the tubular body 38 is a flapper member 32, which may be connected to the tubular body 38 via hinge 70 and serves as the occluding member 24 of the isolation tool 14. The flapper member 32 may be biased towards the seated position (FIG. 5) such as by a spring (not shown) at the hinge 70. The tubular member 38 includes a seat 26, however the flapper member 32 is unseated in FIGS. 2-4. The flapper member 32 is forced against its bias into the unseated position by the sleeve 68, with the flapper member 32 trapped between the sleeve 68 and the structure 12, which corresponds to an open condition of the isolation tool 14 in FIGS. 2-4. As shown in FIG. 4, fluid flow is able to flow longitudinally through the sleeve 68 through an orifice 72 in the longitudinally movable sleeve 68. However, with sufficient fluid velocity, the pressure differential across the orifice 72 will move the sleeve 68 in the downhole direction 30 and into the position shown in FIG. 5. Once the sleeve 68 is moved downhole, the flapper member 32 will move to its biased seated position, corresponding to a closed condition of the isolation tool 14. Also, the sleeve 68 may include an exterior groove 74, which receives the snap ring 66 therein when aligned with the interior groove 64. The snap ring 66 can thus prevent over-travel of the sleeve 68 within the tubular body 38 due to the pressure differential. Other alternative over-travel prevention devices may be provided, such as an interior shoulder extending radially inward from the tubular body 38 upon which the sleeve 68 may abut after moving in the downhole direction 30 a sufficient distance to allow the flapper member 32 to move to the seated position.

In a method of operating the isolation tool 14 shown in FIGS. 2-5, after the isolation tool 14 is set, fluid flow through the inner diameter creates pressure differential across the orifice 72 in the sleeve 68. With sufficient fluid velocity, the pressure differential moves the sleeve 68 in the downhole direction 30, allowing the flapper member 32 to move to the seated position onto seat 26 of the tubular body 38. When the flapper member 32 is in the seated position, the snap ring 66 will lock the sleeve 68 relative to the tubular body 38. The isolation tool 14 thus allows fluid to move through the tool 14 when the flapper member 32 is in the unseated position. However, if sufficient velocity is pumped through the tool 14 in the downhole direction 30, the flapper member 32 will shut and be seated upon seat 26, thus stopping or at least substantially preventing further flow in the downhole direction 30 past the flapper member 32.

Figure 6:
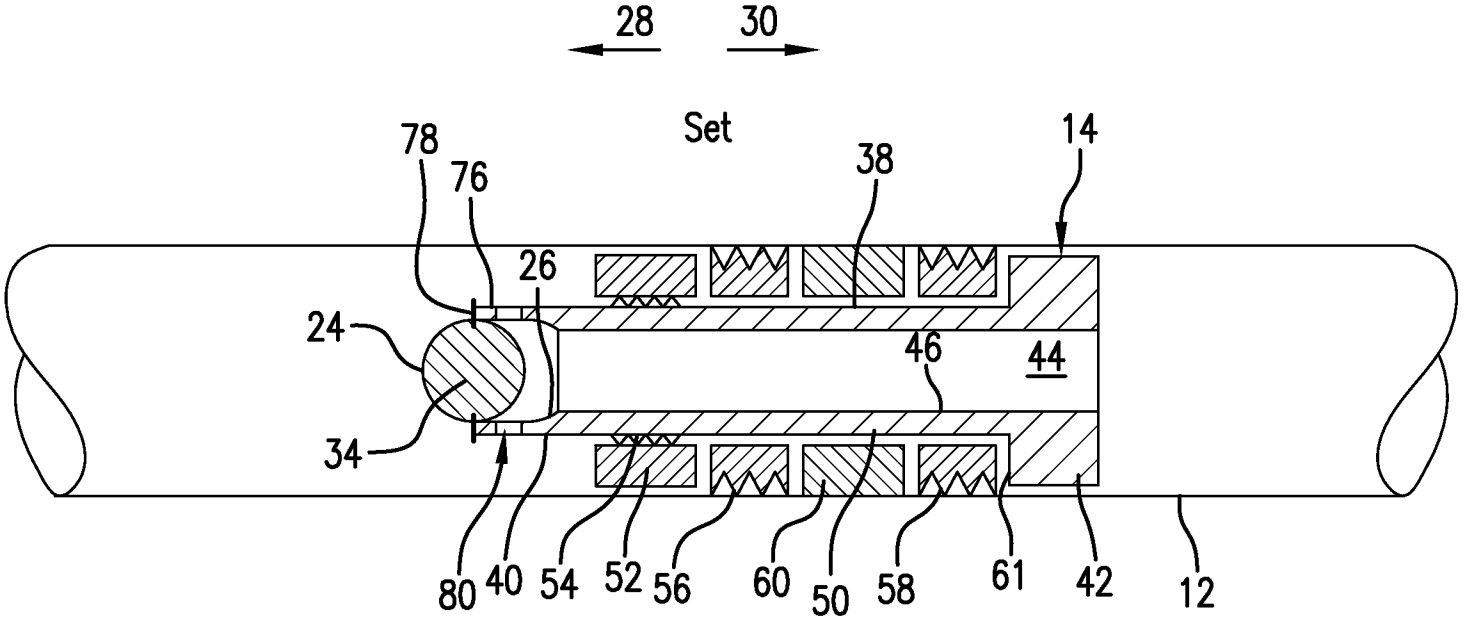
FIG. 6 depicts a sectional and schematic view of an embodiment of an isolation tool for the downhole assembly of FIG. 1 in a set and open condition and having a ball.
Figure 7:
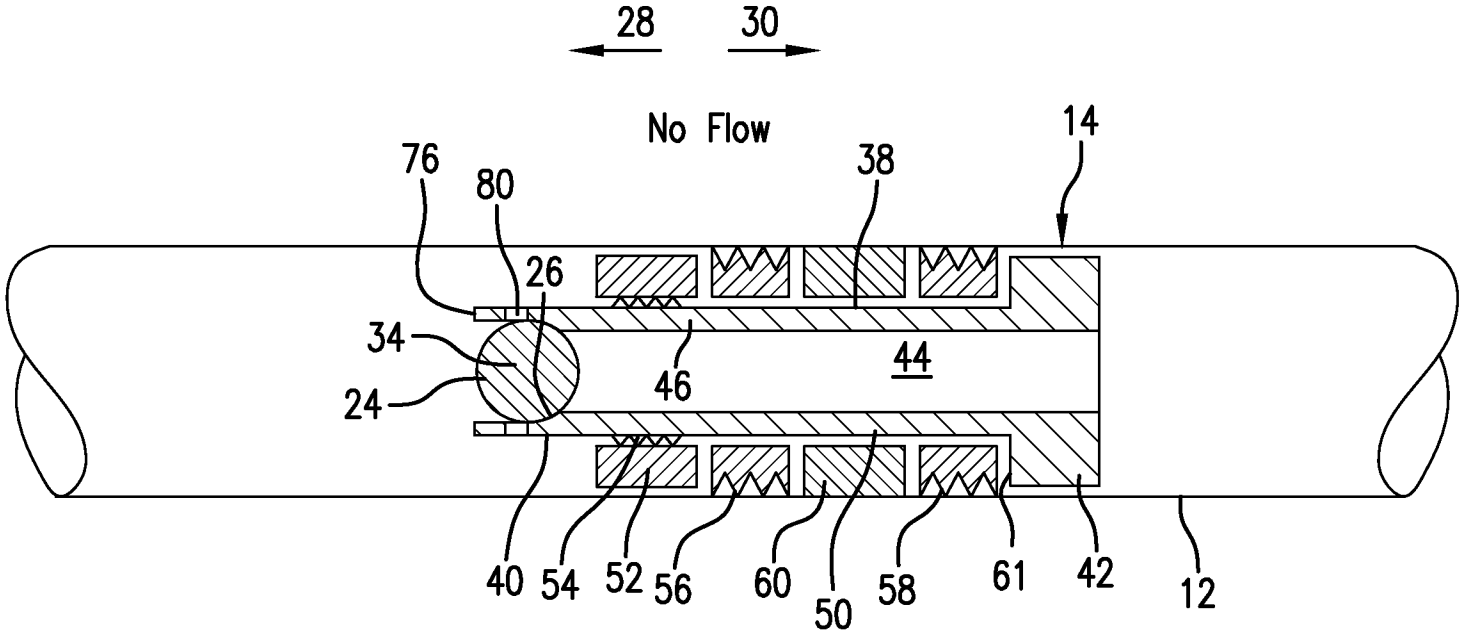
FIG. 7 depicts a sectional and schematic view of the isolation tool of FIG. 6 in a closed condition.

Turning now to FIGS. 6-7, a seat 26 is provided within the tubular body 38 for receiving an occluding device 24, such as a ball 34, thereon. The ball 34 serves as the occluding device 24 of the isolation tool 14 and is unseated in FIG. 6 and seated in FIG. 7. A section 76 or "cage" longitudinally extends from the uphole portion 40 of the tubular body 38 (or may be integral with the tubular body 38). The ball 34 is secured by one or more defeatable devices, such as shear pins 78, to the section 76. The section 76 may enable fluid to flow downhole around the ball 34, via ports 80 or other apertures in the section 76, and through the tubular body 38 of the isolation tool 14 when the ball 34 is in the unseated condition. In lieu of, or in addition to ports 80, the ball 34 may alternatively be suspended by the shear pins 78 to section 76 such that a space is created between an outer diameter of the ball 34 and an inner diameter of the section 76 to enable flow therepast when the ball 34 is in the unseated position.

In a method of operating the isolation tool 14 shown in FIGS. 6-7, after the isolation tool 14 is set, flow through the inner diameter of the structure 12 creates pressure differential across the ball 34. With sufficient fluid velocity, the pressure differential will defeat the shear pins 78, allowing the ball 34 to move downhole onto the seat 26. The isolation tool 14 thus allows fluid to move through the tool 14 when the ball 34 is in the unseated position. However, if sufficient velocity is pumped through the tool 14 in the downhole direction 30, the ball 34 will be forced onto the seat 26, thus stopping or at least substantially preventing further flow in the downhole direction 30 past the isolation tool 14.

Figure 8:
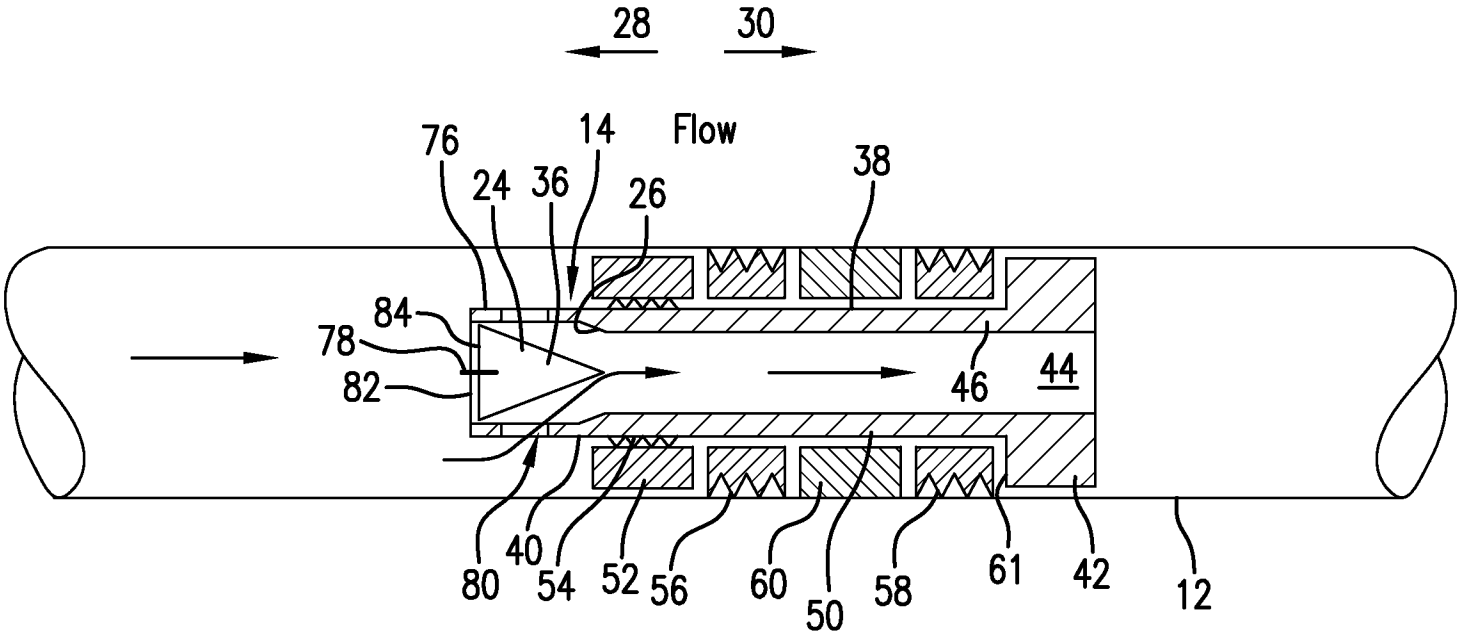
FIG. 8 depicts a sectional and schematic view of an embodiment of an isolation tool for the downhole assembly of FIG. 1 in a set and open condition and having a poppet.
Figure 9:
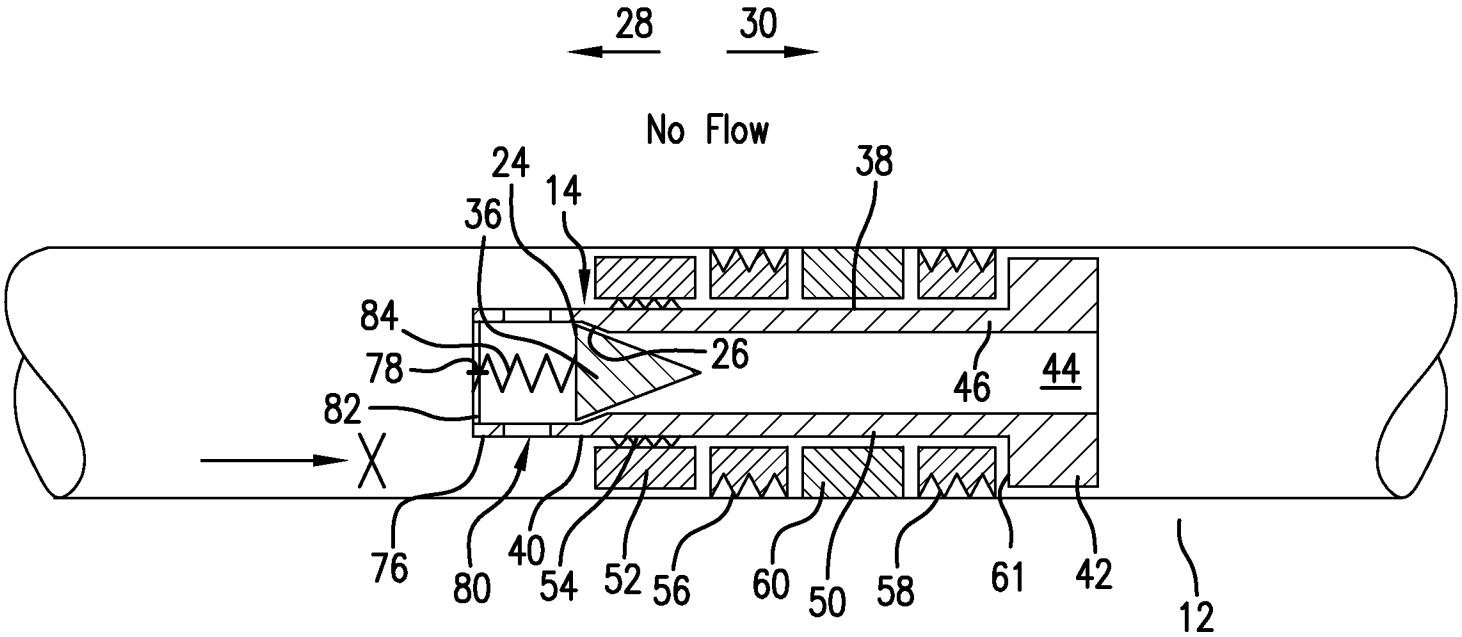
FIG. 9 depicts a sectional and schematic view of the isolation tool of FIG. 8 in a closed condition.

Turning now to FIGS. 8-9, a seat 26 is provided within the tubular body 38 for receiving an occluding device 24, such as a poppet 36, thereon. The poppet 36 serves as the occluding device 24 of the isolation tool 14 and is unseated in FIG. 8 and seated in FIG. 9. A ported section 76 or "cage" longitudinally extends from the uphole portion 40 of the tubular body 38 (or may be integral with the tubular body 28). The ported section 76 further includes a support 82 that extends radially across a portion of the interior of the structure 12. The poppet 36 is secured by one or more defeatable devices, such as shear pin 78, to the support 82 of the ported section 76. A spring 84 in a compressed (energized) state is operatively disposed between the poppet 36 and the support 82. The spring 84 is maintained in the compressed condition via the defeatable device 78 that secures the poppet 36 to the support 82. The ported section 76 enables fluid to flow downhole around the poppet 36, via the ports 80 or other apertures in the ported section 76, and through the tubular body 38 of the isolation tool 14 when the poppet 36 is in the unseated condition.

In a method of operating the isolation tool 14 shown in FIGS. 8-9, after the isolation tool 14 is set, flow through the inner diameter of the structure 12 creates pressure differential across the poppet 36. With sufficient fluid flow, the pressure differential will defeat the shear pin 78, allowing the poppet 36 to move downhole onto the seat 26, with the spring 84 at least partially de-energized and de-compressed into its biased condition. The isolation tool 14 thus allows fluid to move through the tool 14 when the poppet 36 is in the unseated condition, via the ported section 76. However, if a sufficient velocity of fluid is pumped through the tool 14 in the downhole direction 30, the poppet 36 will be forced onto the seat 26, thus stopping or at least substantially preventing further flow in the downhole direction 30 past the isolation tool 14.

Figure 10:
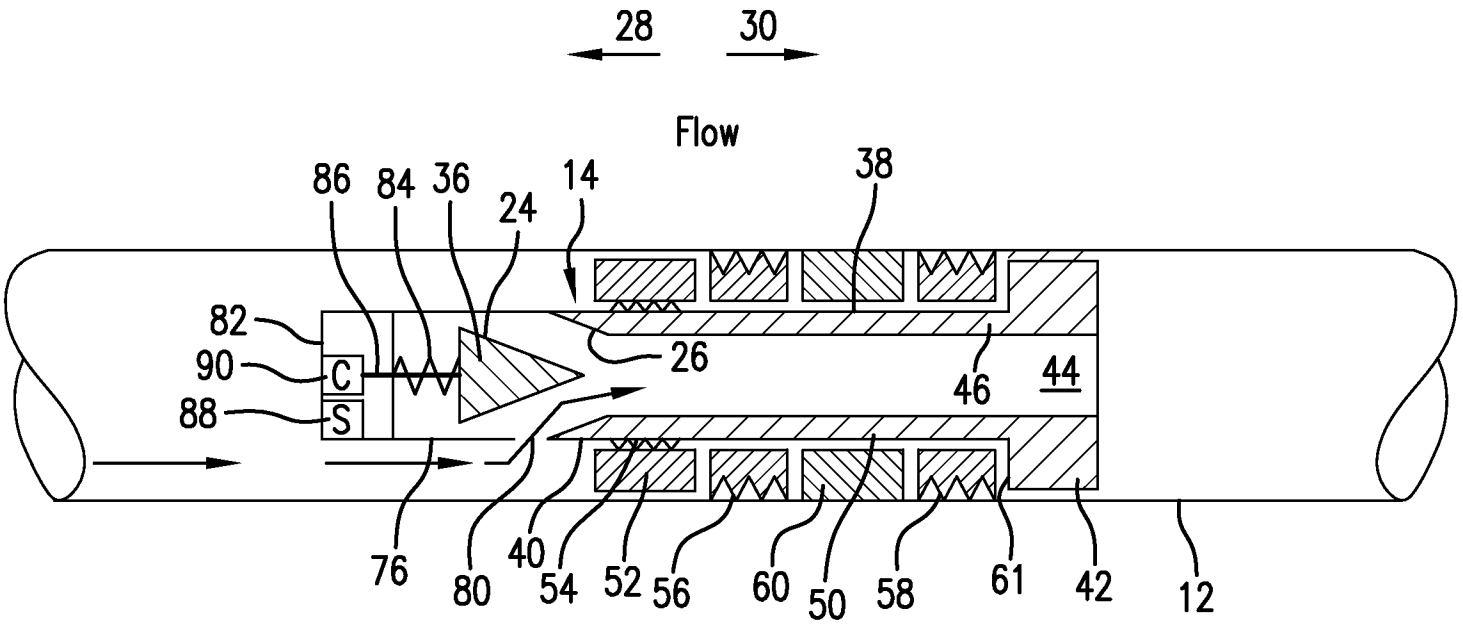
FIG. 10 depicts a sectional and schematic view of an embodiment of an isolation tool for the downhole assembly of FIG. 1 having a sensor and in a set and open condition; and, FIG. 11 depicts a sectional and schematic view of the isolation tool of FIG. 10 in a closed condition.
Figure 11:
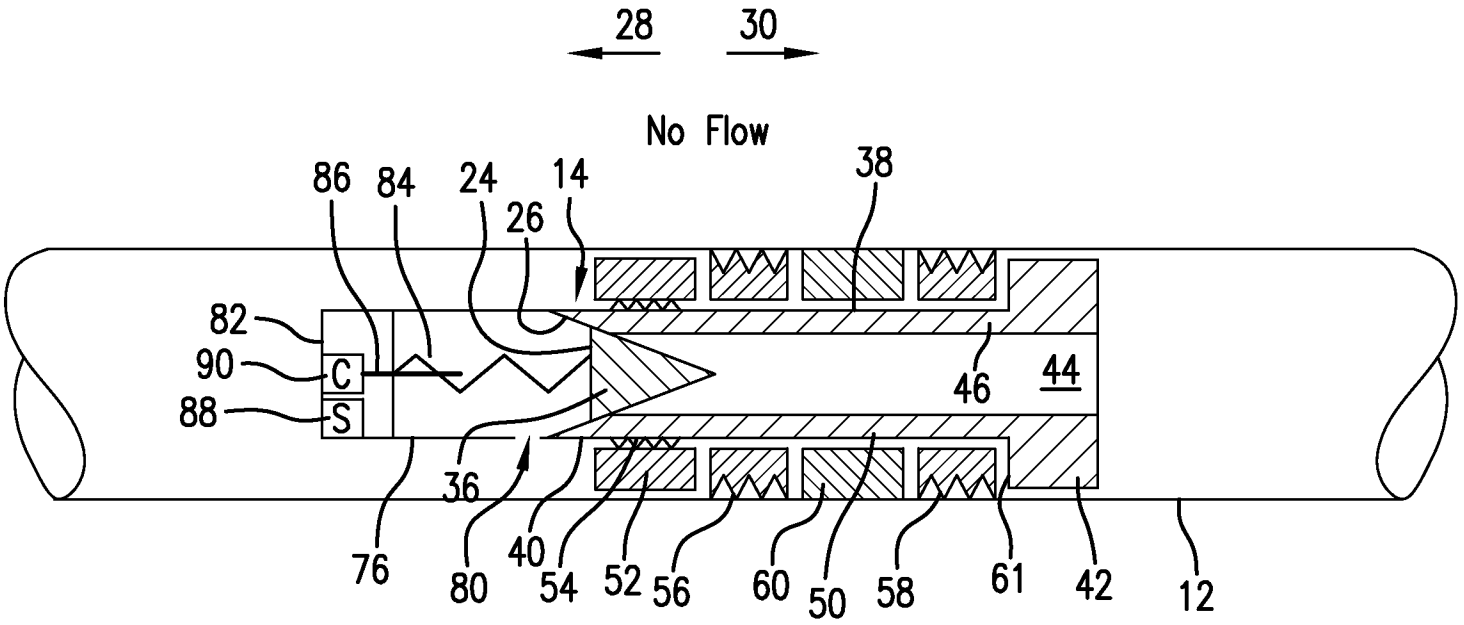

Turning now to FIGS. 10-11, a seat 26 is provided within the tubular body 38 for receiving an occluding device 24, such as a poppet 36, thereon. The poppet 36 serves as the occluding device 24 of the isolation tool 14 and is unseated in FIG. 10 and seated in FIG. 11. However, in alternative embodiments, the isolation tool 14 of FIGS. 10-11 may incorporate other occluding devices 24 including, but not limited to, the ball 34 as shown in FIGS. 6-7 and the flapper member 32 as shown in FIGS. 2-5. As shown in the illustrative embodiment depicted in FIGS. 10-11, a ported section 76 or "cage" longitudinally extends from the uphole portion 40 of the tubular body 38 (or may be integral with the tubular body 38). The ported section 76 further includes a support 82 that extends radially across a portion of the interior of the structure 12. The poppet 36 is secured by one or more release elements, such as release pin 86, to the support 82 of the ported section 76. The support 82 includes a sensor 88, such as an acoustic or inertial sensor that is sensitive to the firing of the gun 18. The support 82 also includes a controller 90 that controls the release pin 86. In the embodiments where the occluding device 24 is a ball 34 or flapper member 32, the release pin 86 would be arranged to operatively restrain the ball 34 or flapper member 32 in the unseated position. A spring 84 in a compressed (energized) state is operatively disposed between the poppet 36 and the support 82. The spring 84 is maintained in the compressed condition via the release pin 86 that secures the poppet 36 to the support 82. The ported section 76 enables fluid to flow downhole around the poppet 36, into the ports 80 or other apertures in the ported section 76, and through the tubular body 38 of the isolation tool 14 when the poppet 36 is in the unseated condition.

In a method of operating the isolation tool 14 shown in FIGS. 10-11, after the isolation tool 14 is set, and after the guns 18 are fired, the controller 90 will receive a signal from the sensor 88 that the guns 18 have fired and trigger the release pin 86 to release the poppet 36 (or ball 34 or flapper member 32) from the support 82, or alternatively release the occluding device 24 from a structure restraining the occluding device 24 into an unseated position. The poppet 36 will then be driven onto the seat 26 by the spring 84, such that the spring 84 at least partially de-energizes and de-compresses into its biased condition. The isolation tool 14 thus allows fluid to move through the tool 14 when the poppet 36 is in the unseated condition, via the ported section 76. However, after the guns 18 fire, the poppet 36 (or other occluding device 24) will be forced onto the seat 26, thus stopping or at least substantially preventing further flow in the downhole direction 30 past the isolation tool 14.

The isolation tool 14, or frac plug, is thus allowed to have an open bore, but will self-occlude in response to gun shock or fluid velocity (which can occur after the guns 18 are fired). This eliminates the "ball drop" from surface to occlude the isolation tool as is currently done. Also, this eliminates the use of water and time to get the ball down to the isolation device, resulting in substantial savings for the operator. This also eliminates the need to provide any additional ball drop device. The isolation tool 14 incorporates a self-occluding mechanism to self occlude in response to gun shock or other communication from the gun bottom hole assembly ("BHA"). The occluding device may be a ball 34, poppet 36, sleeve valve, flapper 32, or any other manner of occlusion. The communication could be pressure wave inertia, sound, fluid velocity. The occlusion device 24 remains unseated until sufficient velocity is pumped through the isolation device 14 or a sensor 88 indicates that the guns 18 have fired.

In an embodiment, the isolation tool 14 includes occluding devices 24 and related components at least partially formed of a disintegratable material that would disintegrate or dissolve after, or as a result of, a fracturing operation. In one embodiment, the disintegrateable material is a controlled electrolytic metallic ("CEM") material. One example of a CEM material is commercially available from Baker Hughes, Inc. under the tradename IN-Tallic®, and is further described in U.S. Pat. Publication No. 2011/0135953 to Xu et al., herein incorporated by reference in its entirety. IN-Tallic® material is a controlled electrolytic metallic ("CEM") nanostructured material that is lighter than aluminum and stronger than some mild steels, but disintegrates when it is exposed to the appropriate fluid through electrochemical reactions that are controlled by nanoscale coatings within the composite grain structure of the material. The occluding devices 24 made of the disintegratable material maintain shape and strength during the fracturing process and then disintegrate before or shortly after the well is put on production. IN-Tallic® material disintegrates over time by exposure to brine fluids, so that the disintegration occurs with most fracturing and wellbore fluids and no special fluid mixture is required. Disintegration rates depend on temperature and the concentration of the brine. Also, acids disintegrate the occluding devices 24 at a much higher rate. This allows the flexibility to pump acid on the occluding device 24 after the fracture is complete, to speed up the disintegration process if desired.

Other components of the isolation tool 14 may be made from composite materials which hold high pressure differentials, have a short lifespan due to temperature degradation in the borehole, and may be drilled out after use in order to put the well on production.

With further reference to FIG. 1, one embodiment of a method of treating a well includes completing a borehole, such as a horizontal borehole, with a "plug and perf" operation. The isolation tool 14 serves the purpose of isolating the previously fractured stages. The BHA includes the isolation tool 14, the setting tool 16, perforating guns 18, and a selective firing head (not shown). Prior to running the downhole system 10 into the structure 12, the isolation tool 14 is attached to the setting tool 16, and the setting tool 16 is attached to the perforating gun 18 and firing head. The assembly 10 is picked up into a lubricator, the lubricator is attached to a wellhead, the assembly 10 is run into the structure 12 by spooling out the line and pumped down the horizontal section using frac pumps. The isolation tool 14 is then set at a desired location using the setting tool 16. The gun 18 is picked up to firing depth, and fired to perforate the structure 12 to provide hydraulic access to the formation surrounding the structure 12. The guns 18 may be fired in clusters of holes radiating in a plurality of directions from the borehole. After successfully firing the guns 18, the method further includes pumping fracturing fluid into the structure 12, such that fluid will flow into perforations created by the perforating guns 18.

A selected fluid velocity through the isolation tool 14, or gun shock, will close the isolation tool 14, allowing all, or at least a substantial portion of, frac fluid to enter the perforations in the structure. If guns 18 fail to fire, the BHA 10 can be pulled from the structure 12, and the isolation tool 14 remains un-occluded. A second BHA (including at least new perforation gun 18) is pumped into the borehole at a slow enough rate such that the already-set isolation tool 14 will not close. New guns 18 are fired and the method returns to the procedure involving pumping into the well such that fluid will flow into perforations. The occluding device 24 of the isolation tool 14 will be moved to the seated position upon successful firing of the guns 18, or subsequent fluid velocity after the guns 18 are fired.

Set forth below are some embodiments of the foregoing disclosure:

Embodiment 1: A downhole assembly comprising: an isolation tool disposable downhole of a perforation gun, the isolation tool comprising: a tubular body having a seat; and, an occluding device supported on the tubular body in an unseated position, and movable to a seated position on the seat in response to at least one of a firing operation of the perforation gun and a selected fluid velocity through the isolation tool; wherein fluid communication through the isolation tool is allowed in uphole and downhole directions in the unseated position of the occluding device, and blocked in the downhole direction in the seated position of the occluding device.

Embodiment 2: The downhole assembly of embodiment 1, wherein fluid communication through the isolation tool is allowed in the uphole direction in the seated position of the occluding device.

Embodiment 3: The downhole assembly of embodiment 1, further comprising the perforation gun disposed uphole of the isolation tool, wherein the occluding device is only movable to the seated position after a firing operation of the perforation gun.

Embodiment 4: The downhole assembly of embodiment 3, wherein the isolation tool includes a sensor configured to sense the firing operation of the perforation gun.

Embodiment 5: The downhole assembly of embodiment 4, wherein the sensor includes at least one of an inertial sensor and an acoustic sensor.

Embodiment 6: The downhole assembly of embodiment 4, further comprising a release device configured to restrain the occluding device in the unseated position, wherein the release device is operatively disposed to release the occluding device upon receipt of a signal from the sensor.

Embodiment 7: The downhole assembly of embodiment 1, wherein the occluding device is a flapper member.

Embodiment 8: The downhole assembly of embodiment 1, wherein the occluding device is a poppet.

Embodiment 9: The downhole assembly of embodiment 1, wherein the occluding device is a ball.

Embodiment 10: The downhole assembly of embodiment 1, wherein the isolation tool includes a ported section between the seat and the occluding device in the un-seated position.

Embodiment 11: The downhole assembly of Embodiment 10, wherein the occluding device is connected to the ported section with at least one defeatable member in the un-seated position, the at least one defeatable member is defeated in the seated position of the occluding device.

Embodiment 12: The downhole assembly of embodiment 11, wherein the at least one defeatable member includes a shear pin.

Embodiment 13: The downhole assembly of embodiment 1, wherein the isolation tool further includes a settable member configured to set the isolation tool within an outer downhole structure.

Embodiment 14: The downhole assembly of embodiment 1, wherein movement of the occluding device from the unseated position to the seated position is velocity activated by the selected fluid velocity in a downhole direction through the isolation tool.

Embodiment 15: The downhole assembly of embodiment 1, further comprising a longitudinally movable sleeve disposed within the tubular body, the sleeve including an orifice, wherein a first position of the sleeve supports the occluding device in the unseated position, and fluid flow through the orifice moves the sleeve to a second position and enables movement of the occluding device to the seated position.

Embodiment 16: The downhole assembly of embodiment 1, wherein the occluding device is made of a disintegrateable material.

Embodiment 17: The downhole assembly of embodiment 16, wherein the disintegrateable material is a controlled electrolytic metallic nanostructured material.

Embodiment 18: A method of completing a borehole, the method comprising: running a downhole assembly having an isolation tool into the borehole, the isolation tool including a tubular body having a seat, and an occluding device supported on the tubular body in an unseated position; firing a perforation gun; and, moving the occluding device from the unseated position to a seated position upon the seat only if the perforation gun is fired.

Embodiment 19: The method of embodiment 18, wherein the isolation tool includes a sensor sensing the firing of the perforation gun, and the occluding device is moved to the seated position in response to a signal from the sensor.

Embodiment 20: The method of embodiment 18, further comprising pumping fluid through the borehole after the perforation gun is fired, and using fluid velocity of the fluid pumped through the borehole to move the occluding device from the unseated position to the seated position.

Embodiment 21: The method of embodiment 18, wherein fluid communication through the isolation tool is enabled in uphole and downhole directions in the unseated position of the occluding device, and blocked in the downhole direction in the seated position of the occluding device.

Embodiment 22: The method of embodiment 18, further comprising, in an event where the perforation gun fails to fire, pulling the perforation gun from the well and running a replacement perforation gun in the well, wherein the occluding device in the unseated position enables fluid communication in a downhole direction for redeployment of the replacement perforation gun.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole assembly comprising:

an isolation tool disposable downhole of a perforation gun, the isolation tool comprising:

a tubular body having a seat;

a settable member configured to set the isolation tool within an outer downhole structure prior to a firing operation of the perforation gun, the settable member movable from an unset condition to a set condition using a setting tool disposable uphole of the isolation tool;

an occluding device supported on the tubular body in an unseated position, and only movable to a seated position on the seat in response to firing operation of the perforation gun;

wherein fluid communication through the isolation tool is allowed in uphole and downhole directions in the unseated position of the occluding device, and blocked in the downhole direction in the seated position of the occluding device.

2. The downhole assembly of claim 1, wherein fluid communication through the isolation tool is allowed in the uphole direction in the seated position of the occluding device.

3. The downhole assembly of claim 1, further comprising the perforation gun disposed uphole of the isolation tool.

4. The downhole assembly of claim 3, wherein the isolation tool includes a sensor configured to sense the firing operation of the perforation gun.

5. The downhole assembly of claim 4, wherein the sensor includes at least one of an inertial sensor and an acoustic sensor.

6. The downhole assembly of claim 4, further comprising a release device configured to restrain the occluding device in the unseated position, wherein the release device is operatively disposed to release the occluding device upon receipt of a signal from the sensor.

7. The downhole assembly of claim 1, wherein the occluding device is a flapper member.

8. The downhole assembly of claim 1, wherein the occluding device is a poppet.

9. The downhole assembly of claim 1, wherein the occluding device is a ball.

10. The downhole assembly of claim 1, further comprising the setting tool disposed uphole of the isolation tool.

11. The downhole assembly of claim 1, further comprising a longitudinally movable sleeve disposed within the tubular body, the sleeve including an orifice, wherein a first position of the sleeve supports the occluding device in the unseated position, and fluid flow through the orifice moves the sleeve to a second position and enables movement of the occluding device to the seated position.

12. The downhole assembly of claim 1, wherein the occluding device is made of a disintegrateable material.

13. The downhole assembly of claim 12, wherein the disintegrateable material is a controlled electrolytic metallic nanostructured material.

14. A downhole assembly comprising:

an isolation tool disposable downhole of a perforation gun, the isolation tool comprising:

a tubular body having a seat;

an occluding device supported on the tubular body in an unseated position, and movable to a seated position on the seat in response to at least one of a firing operation of the perforation gun and a selected fluid velocity through the isolation tool; and a ported section between the seat and the occluding device in the un-seated position;

wherein fluid communication through the isolation tool is allowed in uphole and downhole directions in the unseated position of the occluding device, and blocked in the downhole direction in the seated position of the occluding device.

15. The downhole assembly of claim 14, wherein the occluding device is connected to the ported section with at least one defeatable member in the un-seated position, the at least one defeatable member is defeated in the seated position of the occluding device.

16. The downhole assembly of claim 15, wherein the at least one defeatable member includes a shear pin.

17. The downhole assembly of claim 14, wherein movement of the occluding device from the unseated position to the seated position is velocity activated by the selected fluid velocity in a downhole direction through the isolation tool.

18. A method of completing a borehole, the method comprising:

running a downhole assembly having an isolation tool into the borehole, the isolation tool including a tubular body having a seat, and an occluding device supported on the tubular body in an unseated position;

firing a perforation gun;

moving the occluding device from the unseated position to a seated position upon the seat only if the perforation gun is fired; and in an event where the perforation gun fails to fire, pulling the perforation gun from the well and running a replacement perforation gun in the well, wherein the occluding device in the unseated position enables fluid communication in a downhole direction for redeployment of the replacement perforation gun.

19. The method of claim 18, further comprising pumping fluid through the borehole after the perforation gun is fired, and using fluid velocity of the fluid pumped through the borehole to move the occluding device from the unseated position to the seated position.

20. The method of claim 18, wherein fluid communication through the isolation tool is enabled in uphole and downhole directions in the unseated position of the occluding device, and blocked in the downhole direction in the seated position of the occluding device.

21. A method of completing a borehole, the method comprising:

running a downhole assembly having an isolation tool into the borehole, the isolation tool including a tubular body having a seat, and an occluding device supported on the tubular body in an unseated position;

firing a perforation gun; and, moving the occluding device from the unseated position to a seated position upon the seat only if the perforation gun is fired;

wherein the isolation tool includes a sensor sensing the firing of the perforation gun, and the occluding device is moved to the seated position in response to a signal from the sensor.

* * * * *